US005322297A

United States Patent [19]

Smith

[11] Patent Number: 5,322,297

[45] Date of Patent: Jun. 21, 1994

[54] C & B TRI-SLICER BROADHEAD

[76] Inventor: Roland C. Smith, 6634 Sampson St., Falls Church, Va. 22042

[21] Appl. No.: 91,825

[22] Filed: Jul. 13, 1993

[51] Int. Cl.[5] ..... F42B 6/08

[52] U.S. Cl. ..... 273/421

[58] Field of Search ..... 273/421, 422, 419, 420

[56] References Cited

U.S. PATENT DOCUMENTS

| | | | |
|---|---|---|---|
| 2,859,970 | 11/1958 | Doonan | 273/421 |
| 4,006,901 | 2/1977 | Simo | 273/421 |
| 4,099,720 | 7/1978 | Zeren | 273/422 |
| 4,203,601 | 5/1980 | Simo | 273/421 |
| 4,973,060 | 11/1990 | Herzing | 273/421 |
| 4,998,738 | 3/1991 | Puckett | 273/421 |
| 5,102,147 | 4/1992 | Szeluga | 293/422 |

*Primary Examiner*—Paul E. Shapiro

*Attorney, Agent, or Firm*—Terrance L. Siemens

[57] ABSTRACT

A broadhead for connecting to the end of an arrow comprises a shaft having a longitudinal cylindrical shaped body and a plurality of blades pivotally attached to a blade holder that is slidably mounted upon the shaft. The blades are resiliently held in a retracted position during flight by at least one O-ring. When the broadhead impacts against an animal, the blade holder is slidably forced rearward allowing the blades to pivot outward into an extended position.

6 Claims, 2 Drawing Sheets

C & B TRI-SLICER BROADHEAD

BACKGROUND OF THE INVENTION

The present invention pertains to the field of game hunting with a bow and arrow, more specifically to a broadhead for an arrow, and even more particularly to a broadhead having cutting blades that are positively held retracted during flight, for greater accuracy, but are easily and forcibly extended upon striking an intended target. Specifically, in the instant invention, a blade holder is thrust backwards on a shaft by target impact thus causing the cutting blades to become extended.

SUMMARY OF THE INVENTION

The use of a bow and arrow for hunting game animals has been practiced for many years. A need has always existed to provide a broadhead of such configuration that is capable of traveling at a speed sufficient to insure a quick kill, yet maintain its accuracy during flight. Thus, it is apparent that it is necessary to provide a broadhead in which the cutting blades are held firmly against the arrow body during flight to avoid any air resistance, but, upon impact, the cutting blades open quickly to insure a quick kill. The following references are representative of the art relating to broadhead assemblies having deployable cutting blades that open upon impact.

U.S. Pat. No. 4,932,671 to Anderson discloses a fanton bladed broadhead. The Anderson broadhead provides for the cutting blades to be retracted in a longitudinal slot on the outer peripheral of the hollow body. The cutting blades are forced into an open position when a plunger hits the animal and is pushed inward to engage and force the blades into an extended position. A ring is disclosed for encircling the cutting blades and holding the blades on the outer body by an outer notch.

U.S. Pat. No. 5,082,292 to Puckett discloses a broadhead that provides for retracted blades during flight. Puckett shows a broadhead comprising a bore with a hollow body. The cutting blades are pivotally connected at one end to a plunger and upon impact with an animal, the plunger is pushed inward within the bore causing the blades to become extended.

U.S. Pat. No. 5,102,147 to Szeluga discloses a ballistic broadhead comprising a longitudinal slot extending laterally through the body. The blades are secured to a plunger by an O-ring and upon impact, the plunger is depressed into the body carrying with it the blades which are forced into an open position.

All of the prior art references discussed above employ a plunger that upon impact is forced inward within the body to force the blades into an extended position. None of the references, taken singly or in combination, show or make obvious a broadhead with cutting blades held in a resilient retracted position by an O-ring that eliminates air deflection during flight, and upon impact a blade holder that is forced inward to cause the cutting blades to become extended to insure a quick kill.

A broadhead for connecting to the end of an arrow comprising:

a shaft having a longitudinal cylindrical shaped body;

a plurality of cutting blades angularly arranged about said shaft, each having a lower edge;

holding means, slidably mounted on said shaft, for pivotally attaching each of said blades to said holding means; and wherein impact contact from the target causes said holding means to be slidably forced rearward allowing said blades to pivot outwardly to an extended position.

It is an object of the present invention to provide a broadhead in which the blades are held in a retracted position during flight.

Another object of this invention is to provide a broadhead that upon penetration into an animal, the blade holder will slide backwards upon the shaft causing the blades to become extended.

It is still another object of the present invention to provide an interchangeable sleeve for allowing practice with the broadhead arrow without using the cutting blades.

It is still another object of the present invention to provide a broadhead that includes interchangeable components for allowing use of broadheads with varying configurations and weight.

It is still another object of the present invention to use an O-ring to eliminate wind resistance during flight by resiliently holding the cutting blades in a retracted position firmly against the shaft.

A general goal is to provide improved elements and arrangements thereof in an apparatus for the purposes described which is inexpensive, dependable, and fully effective in accomplishing its intended purposes.

It is submitted that the present invention meets or exceeds all the above objects and goals. Upon further study of the specification and appended claims, further objects and advantages of this invention will become apparent to those skilled in the art.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
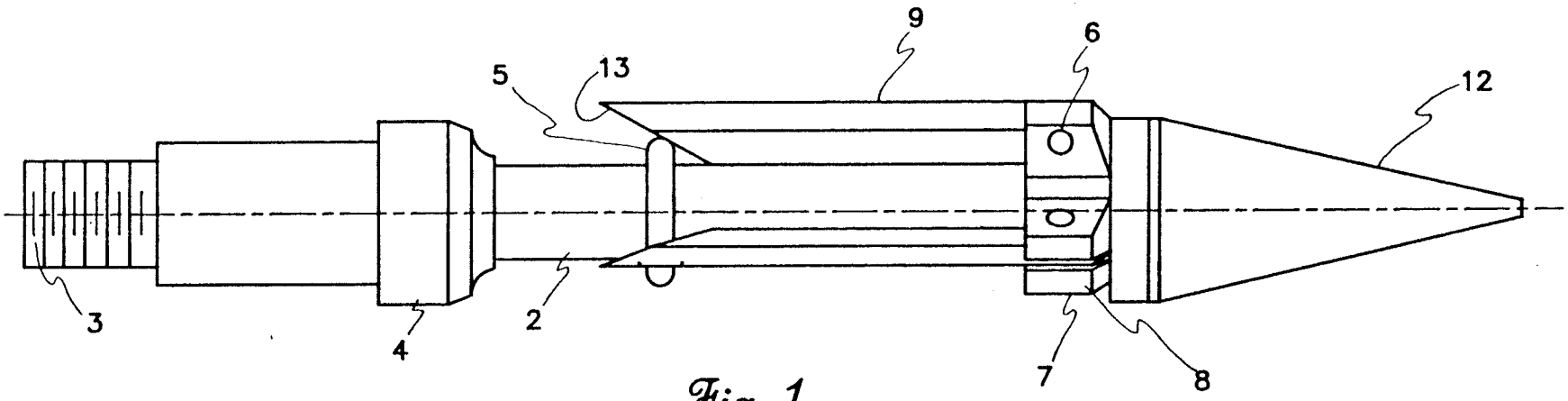
FIG. 1 shows the configuration of the broadhead in a retracted position in accordance with the preferred embodiment of the present invention.

With reference now to the figures, FIG. 1 shows a broadhead assembly 1 adapted to be threadedly secured to an end of an hunting arrow. The threaded end 3 of the broadhead 1 for connecting to the hunting arrow is shown at the left side of FIG. 1. This is the rearward end of the arrow in flight. Hereafter in this specification, all references to forward and rearward will use this reference frame of the arrow.

Figure 4:
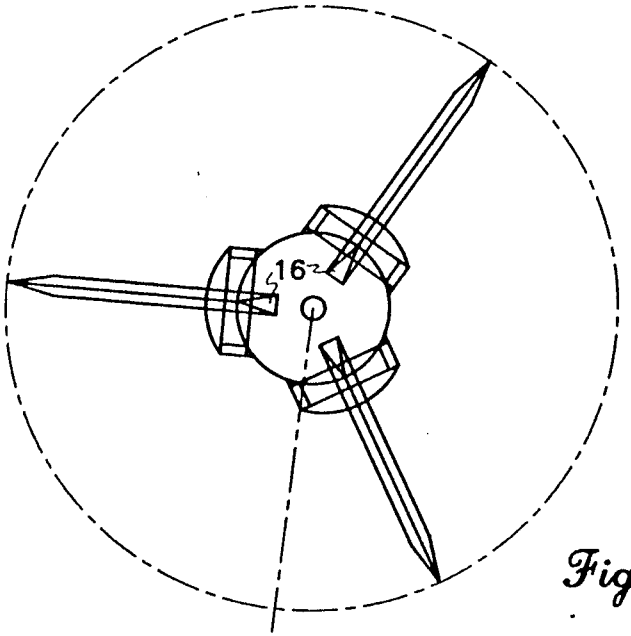
FIG. 4 is an end view of the blade holder with the blades in an extended position.
Figure 6:
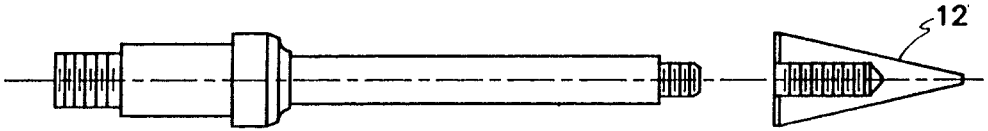
FIG. 6 shows the detail of the threaded removable tip.

The broadhead 1 is comprised of a longitudinal generally cylindrical shaft 2. Integrally formed on the forward end of slide shaft 2 is arrow tip 12. Tip 12 may be threadably removed as shown in FIG. 6. A plurality of spaced longitudinal slots 16 are formed on the outer surface of shaft 2. As clearly shown in FIG. 4, three such slots 16 are circumferentially spaced at 120 degrees from one another. It is contemplated that four slots, spaced at 90 degrees from one another, would also make a satisfactory configuration. Shaft 2 has a blade stopper 4 integral with the shaft between the end of longitudinal slots 16 and threaded end 3. The purpose of blade stopper 4 is to limit the rearward movement of a broadhead blade holder 7 as more fully described later.

Blade holder 7 is slidably mounted on the shaft 2 so as to be slidable rearward towards the blade stopper 4. Blade holder 7 has a plurality of pivot pockets 8 on the outer periphery of the blade holder 7. Each of the pivot pockets 8 include a roll pin 6 for pivotally securing a cutting blade 9 thereto. The radial outward edges of blades 9 are sharpened. As the blades pierce an animal the mechanism described hereinafter causes them to pivot outwardly around their respective roll pins 6. This action causes extensive cutting of the animal near the arrow entry point. This, in turn, leads to a more humane kill because the animal will bleed to death much more quickly. The blade holder 7 is preferably made of steel or aluminum so as to hold a fine edge, but may be comprised of another material to provide a broadhead configuration of a different weight.

An O-ring 5 is provided to position each of the cutting blades 9 before the broadhead is launched. The O-ring 5 is mounted on the shaft 2 adjacent to the blade stopper 4 and directly behind each of the cutting blades 9. O-ring 5 is of a small enough diameter so as to form a firm frictional grip on the portion of shaft 2 which it surrounds. As the broadhead is prepared for launching, the O-ring 5 is pushed resiliently forward against the tapered rear end (opposite the pivoted end) of each of the cutting blades 9 to hold the blades forwardly on the shaft 2. It is within the scope of this invention to use an O-ring 5 of any size and strength, but preferably one that is stable enough to hold the cutting blades securely against the shaft. As will be seen from the following description, the holding of the blades 9 forward on the shaft 2 serves to locate them in a position where outward pivoting is blocked.

Figure 2:
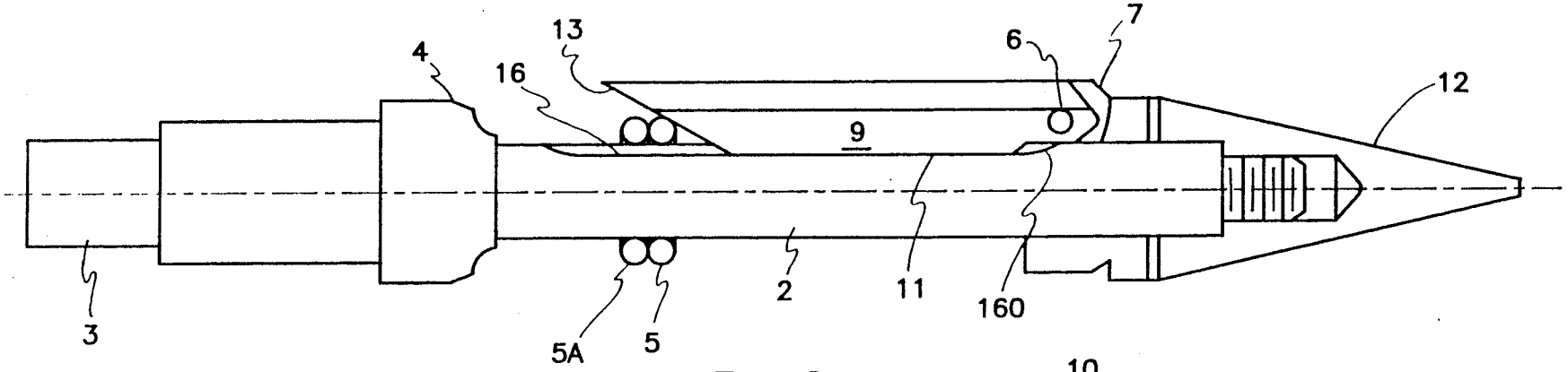
FIG. 2 is an exploded view showing the components of which the broadhead is comprised showing and embodiment using multiple O-rings.

FIG. 2 shows identical components to those of FIG. 1 with the exception that an additional O-ring 5A has been added. This additional O-ring is useful for heavy duty broadheads. Referring to FIG. 2, the detail of the cutting blade 9 pivotally connected to the blade holder 4 is shown in detail. Cutting blade 9 includes ledge 10 along its inside edge spaced forward of pivot roll pin 6. When the blade holder 7 is slid forwardly on shaft 2, pivot point 6 in pivot pocket 8 is also move forwardly. Blade 9 is thus also moved forwardly by virtue of its hinged attachment at 6. When the blade 9 is pulled forward beyond the tapered end **16*a* of longitudinal slot 16 the ledge 10 cams up to the outer surface of shaft 2 and causes the blade 9 to pivot counter-clockwise about pivot 6. This counter-clockwise pivoting of blade 9 causes the offset lower edge of the blade to come into intimate parallel contact with the straight bottom edge of slot 16. In this tucked in position the blade 9 is supported by the sidewalls of slot 16 and cannot pivot outward because of the contact of ledge 10 with shaft 2**. In this position the arrow is aerodynamically sleek and not susceptible to side winds and the like.

It can now be seen that to maintain the blade 9 in the retracted position all that need be done is to maintain the blade holder 7 far enough forward to cause ledge 10 to ride up out of slot 16. The O-ring 5 is the mechanism used to resiliently hold the blades and blade holder in the forward position. It can be readily seen that if the O-ring 5 is slid o rolled against the rear of blade 9, as shown in FIG. 2, the blades, the pivots, and the blade holder cannot move rearwardly without displacing the O-ring. In turn the tightly fitting O-ring cannot be displaced rearwardly unless a considerable rearward force is developed. In practice the rearward releasing force is generated by the contact of the outer periphery of blade holder 7 with the target material upon entry of the arrow into the target. It will be understood that the operation of only a single blade has been described here but all the radially spaced blades will operate in a substantially identical manner.

When an arrow tip 12 having this broadhead attachment penetrates a target the forward outer periphery of blade holder 7 will contact the target material and be forced rearwardly with respect to the arrow and integral shaft 2. The first effect of this rearward movement is to cause the tapered rear portion 13 of blade 9 to push rearwardly on the O-ring 5. One skilled in the art will note that the rearward thrust on O-ring 5 is augmented by an inward thrust on the O-ring by virtue of the taper of rear portion 13. This tends initially to wedge the O-ring 5 against shaft 2 thus increasing the frictional resistance to sliding of the O-ring. This is desirable in that it tends to prevent accidental movement of the securing O-ring during transport and prior to intended use. In the impact with a target there is ample energy available to force the O-ring rearwardly in spite of the wedging action of tapered rear blade portion 13.

As soon as O-ring 5 has displaced rearwardly enough to allow ledge 10 to begin to enter slot 16 near end **16*a* the taper of rear blade portion 13 serves a different purpose. It can be seen that now that, with ledge 10 cleared, the taper of rear blade portion 13 will cause the blades to pivot clockwise about roll pin 6 to the extended position. Thus simple O-ring 5** serves two separate and important functions in this invention. First, it holds the blades and blade holder forward so that inadvertent and premature blade extension is impossible. Second, it acts as a cam assisting in positive blade extension during target entry. This simple dual function element has thus allowed for a reduction in the complexity and expense of prior extensible broadhead devices.

Upon full rearward movement of blade holder 7 the rear portion 13 of blades 9 will contact the sloped forward portion of blade stopper 4 and forcibly rotate blades 9 to a fully rotated position of about 45 degrees. This action is forced as the sharp arrow tip penetrates the target and the blunt forward edges of the blade holder 7 cannot penetrate so easily.

Figure 3:
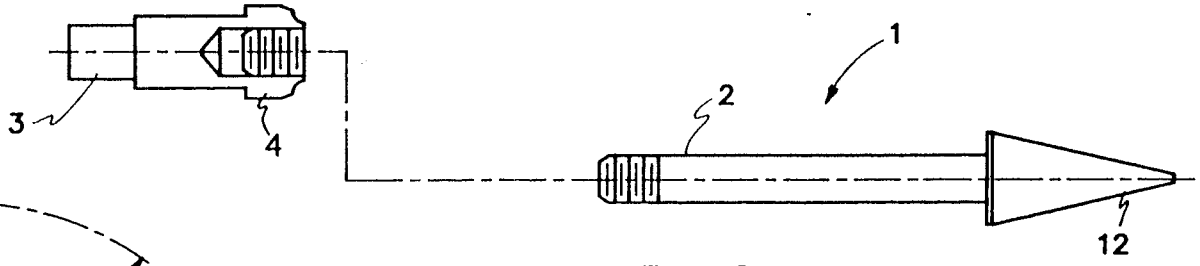
FIG. 3 shows a second embodiment of the present invention.

FIG. 3 illustrates a possible construction of broadhead assembly 1 with internal threads on the blade stopper 4 accepting the external threads on the rearward end of shaft 2. This construction allows for easy assembly and disassembly of the unit and replacement of parts when necessary.

Figure 5:
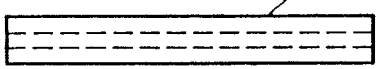
FIG. 5 shows the practice component will replace the blade holder and blades and be used as a practice broadhead.

One advantage of the construction of FIG. 3, just described, is that the forward tip 12 and shaft 2 portion of the broadhead assembly 1 can be easily disengaged to allow the blades 9 and blade holder 7 to be removed from the assembly. After this is done a passive spacer unit 15 as shown in FIG. 5 may be slipped over shaft 2 and the unit reassembled. Passive spacer unit 15 is simply an elongated hollow cylindrical bushing whose internal diameter permits easy sliding over the reduced diameter shaft 2 and whose length is sufficient to extend from the rear of tip 12 to the front of blade stopper 4. Material used for passive spacer unit 15 is preferably some inexpensive type of durable plastic. The expandable blade broadhead function of the invention is now completely disabled and the so modified arrow can be used in ordinary target practice. This conversion feature adds a new dimension to previously known broadhead arrow devices. As seen in FIG. 2, tip 12 may also be threadedly connected to shaft 2 to allow for similar disassembly and addition of the passive spacer element 15 when simple target practice is desired.

From the foregoing description, one skilled in the art can easily ascertain the essential characteristics of this invention and, without departing from the spirit and scope thereof, can make various changes and modifications of the invention to adapt it to various usages and conditions.

The present invention has been described with reference to the preferred embodiment. Obviously, modifications and alterations will occur to others upon reading and understanding the preceding detailed description. It is intended that the invention be construed as including all such modifications and alterations insofar as they come within the scope of the appended claims or the equivalents thereof.

I claim:

1. A broadhead for connecting to the end of an arrow comprising: a shaft having a longitudinal cylindrical shaped body; a plurality of cutting blades angularly arranged about said shaft, each having a lower edge;

holding means, slidably mounted on said shaft, for pivotally attaching each of said blades to said holding means a plurality of longitudinal slots on an outer surface of said shaft, each one of said slots acting as a guide for said lower edge of said respective cutting blades;

a blade stopper integral with said shaft opposite said holding means;

an O-ring slidably mounted between said blade stopper on said shaft and said holding means, wherein;

impact contact from the target causes said holding means to be slidably forced rearward allowing said blades to pivot outwardly to an extended position and said O-ring resiliently holds each of said cutting blades stable in a retracted position during flight.

2. A broadhead according to claim 1, wherein said shaft is made of steel.

3. A broadhead according to claim 1, wherein said shaft is made of aluminum.

4. A broadhead for connecting to an end of an arrow comprising:

a shaft having a longitudinal cylindrical shaped body;

a plurality of cutting blades each having a lower edge;

holding means, slidably mounted on said shaft, for pivotally attaching each of said blades to said holding means; and a blade stopper having a threaded recess therein for threadedly connecting to said shaft.

5. A broadhead according to claim 4, further comprising:

a plurality of longitudinal slots on the outer surface of said shaft, each one of said slots acting as a guide for said lower edge of said respective cutting blades; and an O-ring slidably mounted adjacent to said blade stopper on said shaft opposite said blade holder.

6. A broadhead according to claim 4, further comprising:

a plurality of longitudinal slots on the outer surface of said shaft, each one of said slots acting as a guide for said lower edge of said respective cutting blades; and multiple O-rings slidably mounted adjacent to said blade stopper on said shaft opposite said blade holder.

* * * * *